United States Patent [19]

Bonnet

[11] Patent Number: 4,986,542

[45] Date of Patent: Jan. 22, 1991

[54] GAME BOARD FOR PRACTICING ASPECTS OF BOWLS, BILLIARD AND PETANQUE

[75] Inventor: Jean Bonnet, Tocane-Saint-Apre, France

[73] Assignee: Societe des Jeux d'Aquitaine, France

[21] Appl. No.: 173,817

[22] Filed: Mar. 28, 1988

[30] Foreign Application Priority Data

Mar. 27, 1987 [FR] France ..... 87 04445
Jan. 28, 1988 [FR] France ..... 88 01145

[51] Int. Cl.[5] ..... A63D 3/00; A63D 15/06

[52] U.S. Cl. ..... 273/118 R; 273/6; 273/9; 273/127 B; 273/126 R

[58] Field of Search ..... 273/118 R, 37, 119 R, 273/126 R, 3 R, 6, 2, 8, 123 R, 126 R, 9, 108, 109, 127 B, 127 R

[56] References Cited

U.S. PATENT DOCUMENTS

| | | | |
|---|---|---|---|
| 616,557 | 12/1898 | Phares | 273/37 |
| 799,785 | 9/1905 | Fitzpatrick | 273/37 |
| 972,568 | 10/1910 | Noonan | 273/37 |
| 1,020,315 | 3/1912 | Schutz | 273/126 R |
| 1,080,427 | 12/1913 | Dosch | 273/37 |
| 1,203,805 | 7/1916 | Stephan | 273/37 |
| 1,369,992 | 3/1921 | Turner | 273/3 R |
| 1,599,188 | 9/1926 | Seede | 273/119 R |
| 2,312,882 | 3/1943 | Cusano | 273/126 R |
| 2,468,979 | 5/1949 | Howard | 273/127 R |
| 4,004,804 | 1/1977 | Gholson | 273/127 B |

FOREIGN PATENT DOCUMENTS

| | | | |
|---|---|---|---|
| 558139 | 6/1958 | Canada | 273/118 R |

*Primary Examiner*—David J. Isabella
*Assistant Examiner*—Gary Jackson
*Attorney, Agent, or Firm*—Fulbright & Jaworski

[57] ABSTRACT

A special game board designed for the practice of a game of bowls which associates some aspects of the games of petanque and/or billiards more particularly. The board has a rectangular horizontal plate mounted on legs and edged along its two longitudinal sides with lateral bands or banks, extending above the plate and provided with a padding or similar structure of a resilient material. On at least one of the lateral sides, with a bowl collecting trough, on the plate defined a quadrangular game area extending in the plate half portion provided with the trough. The table is covered with a shock and noise absorbent resilient material which allows the bowls to run and is installed between 40 and 50 cm. A shock and noise absorbing band made up of a curtain is provided on the outer side of each trough.

17 Claims, 5 Drawing Sheets

GAME BOARD FOR PRACTICING ASPECTS OF BOWLS, BILLIARD AND PETANQUE

FIELD OF THE INVENTION

This invention relates to a game board of special design intended for the practice of a new game of bowls associating some rules of particularly billiard and pétanque.

SUMMARY OF THE INVENTION

The object of the invention is, on a limited surface in a room or suitable place, under shelter and regardless of the weather, to provide the opportunity to practice a game of bowls which is related to the game of pétanque in the first place, but also has specific rules even if some of them come from existing games such as the game of pétanque of course, but also from billiard and the so-called lyonese game of bowls.

To this purpose, the object of the invention is a special game board designed for the practice of a game of bowls associating some aspects of the games of pétanque and or billiard more particularly, comprising a rectangular horizontal plate mounted on legs and edged along its two longitudinal sides with lateral bands or banks, extending above the plate and provided with a padding or similar structure of a resilient material, and on at least one of the lateral sides, with a bowl collecting trough, on said plate being defined a quadrangular game area extending in the plate half portion provided with said trough, said table being characterised by the fact that said plate is covered with a shock and noise absorbent resilient material while allowing the bowls to run and is installed at a few tens centimetres above the floor, preferably between 40 and 50 cm, and that said trough or each trough is provided on its outer side with a shock and noise absorbing band consisting of a curtain.

The game is practiced by one or more players, using a target or "jack" and bowls, the diameter of which is substantially smaller than the diameter of billiard bowls, yet having an adequate weight, thrown manually at the plate, like pétanque bowls and according to specific rules that may be, in a rule among many others that are possible, an association of rules taken from the games of billiard, of pétanque and of lyonese bowls.

The game board of the invention is distinguished by the fact that, owing to its short height above the floor, it allows to throw bowls exactly like bowls of pétanque. The structure of the bowl receiving areas, viz the surface of game of the plate and the damping band of the trough or troughs for ball collection, provides a good absorption of both the bowl kinetic energy and of the noise, while permitting the bowls to run well on the surface of the game board.

Therefore this game board really permits to practice a game after the manner of pétanque, with the various specific "shots", such as aiming, shooting, "plombé", "carreau", all which is not possible with the game boards known to date as used with metal discs or bowls.

Other characteristics and advantages will appear from the following description of modes of embodiment of the game board of the invention, the description is given by way of examples only with reference to the drawings enclosed where:

A BRIEF DESCRIPTION OF THE DRAWINGS

DETAILED DESCRIPTION OF THE PREFERRED EMBODIMENT

Figure 1:
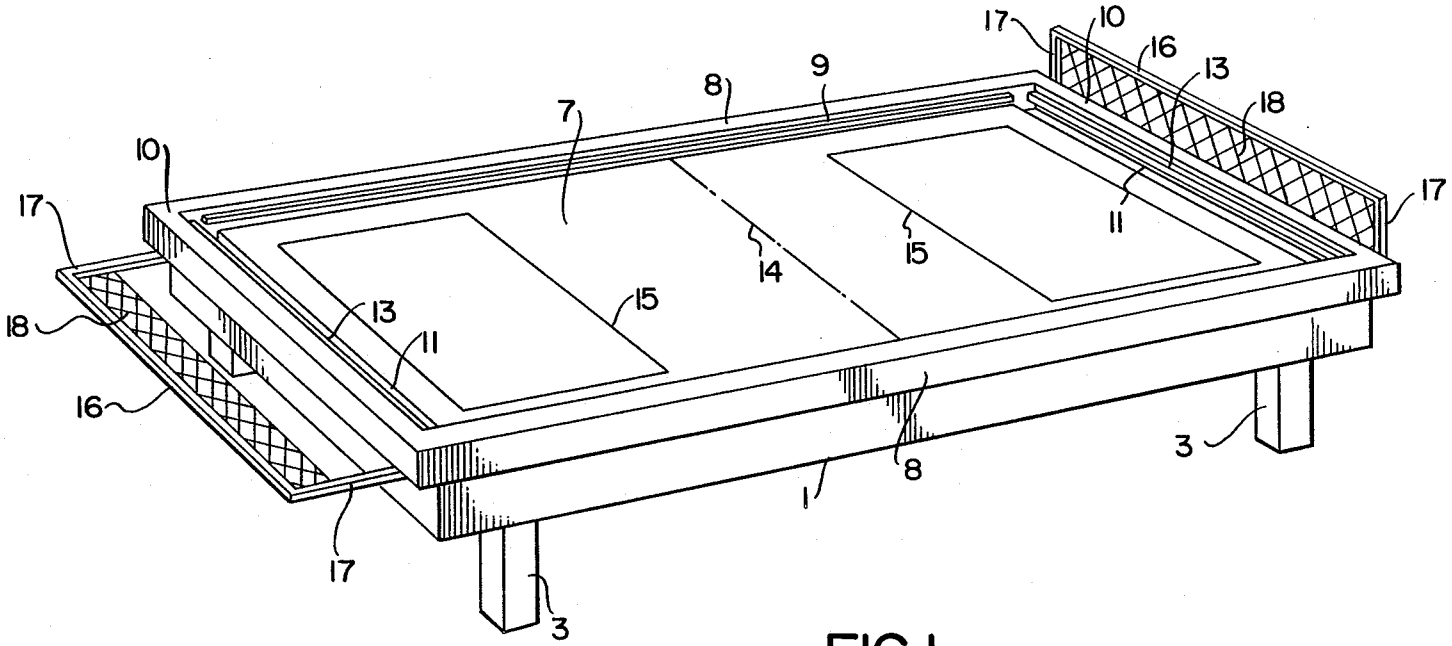
FIG. 1 is a perspective view of a board according to the invention.
Figure 2:
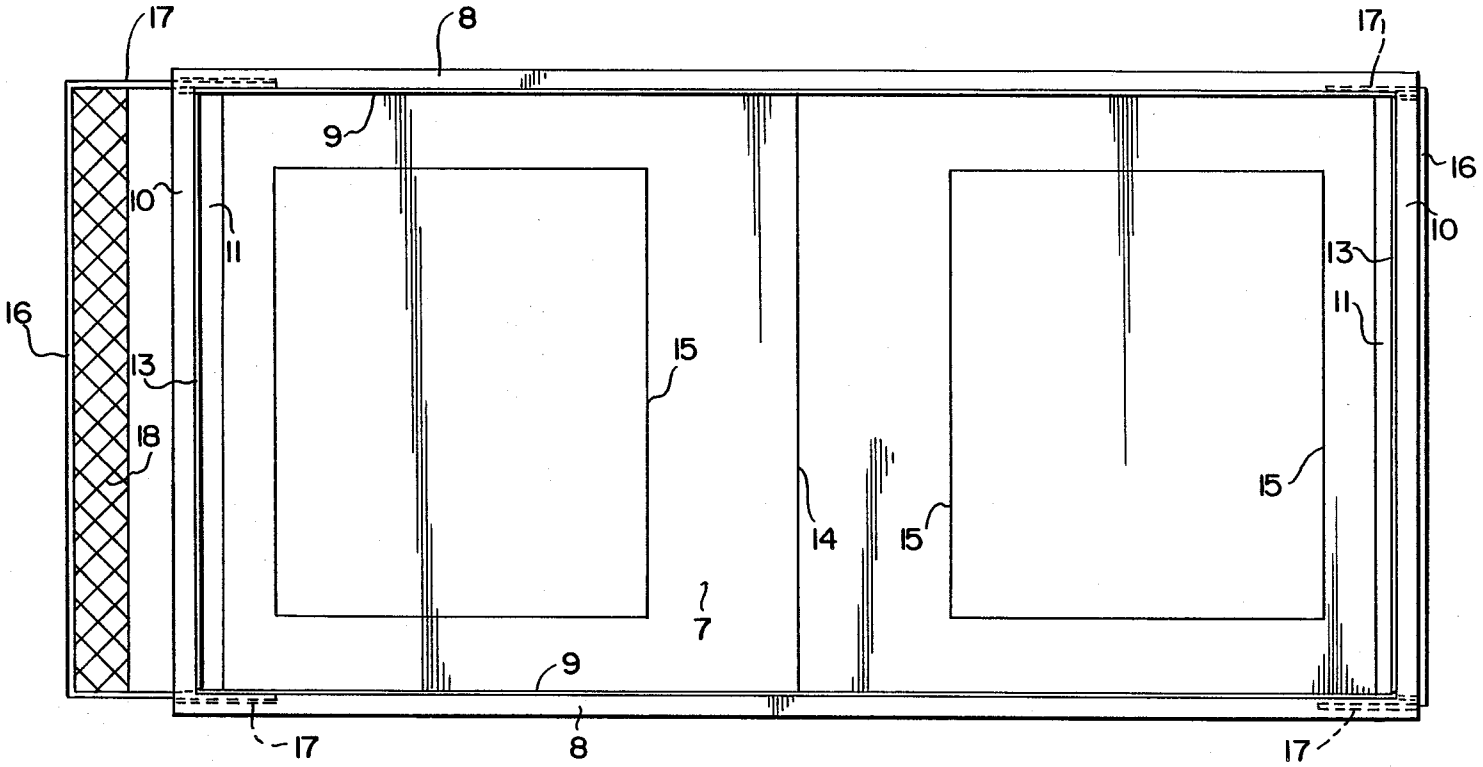
FIG. 2 is a top view of the game board of FIG. 1
Figure 3:
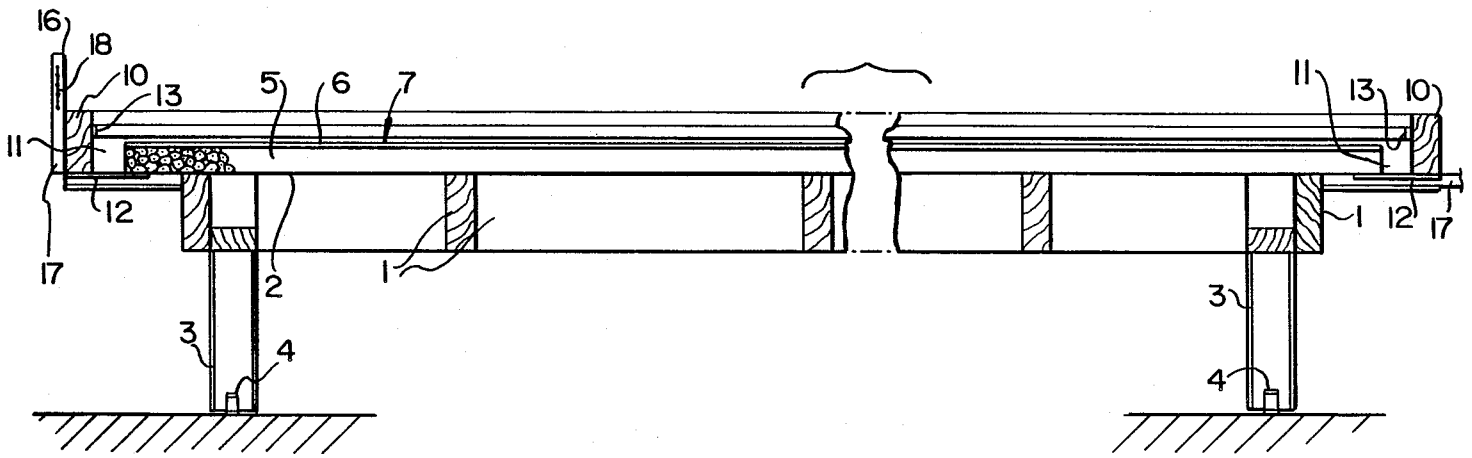
FIG. 3 is a vertical longitudinal section of the game board.

The game board illustrated in FIG. 1 to 3 comprises a rigid framework 1 of any material such as wood, metal, plastics or the like the purpose of which is to carry a rectangular and horizontal plate 2 in a stable and distortion-free manner.

The framework 1 is mounted on four legs 3, also of any material, preferrably of adjustable type by means of levelling screws 4 and if the game board is of folding table, the legs shall be preferrably mounted in a retractable mode The plate 2 is a composite structure comprising a plate 5 of a rigid and non warping material, such as plywood to sea service specifications, with a minimum thickness of 20 mm, said plate being coated with a second plate 6 which may be cork, thickness: a few millimetres, 4 to 5 for instance. The cork plate itself may be covered with a coating of felt or similar material, for instance, the material known under the trade name of TAPISOM or alternatively a material used as game cloth approved for the game named "miniboule".

The surface of game defined by the cloth 7 is preferably at 40 or 50 cm above the floor level.

Along its two longitudinal sides, the table is provided with banks 8 extending above the surface of game defined by the cloth 7, said banks being provided on their inner side with a roll 9 or a band of resilient material, for instance similar to those provided on conventional billiard game boards.

For instance, banks 8 are inserted on the sides of the plate 2.

At right angle with and at a definite distance from both lateral sides of the plate 2, two transoms 10 parallel with said lateral sides are attached. Transoms 10 define at either end of the plate and on its full length, a rectangular opening 11 of constant width to form a bowl collecting trough.

The width of said opening 11 can vary and can be either slightly smaller than or slightly bigger than the diameter of the bowls; in the latter instance, the bottom of said trough is provided with a bowl retaining plate 12.

The transom 10 surface directed toward the plate is preferably coated with a damping band 13 of resilient material installed at a height matching that of the bowls running on the cloth 7.

The cloth 7 is divided into two symmetrical zones of game by a middle line 14 crossing the plate.

In each zone, a line 15 delimits a zone for target throwing, shown with a rectangular configuration in the embodiment illustrated.

With a plate 2 whose dimensions are 2.30 × 1.20 m for instance, the line 15 is at approximately 15 cms of both resilient side bands 9 and at approximatively ten centimetres from the trough 11.

The game board also comprises a so-called game-starting bar 16, parallel with the smaller side of the board, at either ends. The bar 16 is preferably slightly below the plane of cloth 7 and at approximately 20 cm from transom 10.

The bar 16 is retractable under or in both board ends by means of horizontal sections 17 that can be slided under the transom 10 and the side banks 8.

A net 18 capable of taking a vertical position (on the left of FIG. 3) against the transom 10 and in upper extension therefrom shall be preferably mounted between the sections 17 and the bar 16. To this purpose, the sections 17 comprise two portions which can be placed either in the same plane (the game start bar position) or at right angles (protective net position)

In the embodiment shown with double zone of game, of course only one zone is used at a time, and the bar 16 has the protective position on the side of the zone being used and in its other position on the opposite side.

Of course it is possible to have only one zone of game on the cloth 7, in which case there is only one trough 11 and the assembly 16–17 has not necessarily the double function of game start and protection. IN this case, the game board with one trough can be installed against a wall and therefore it can be accommodated in a smaller room.

Also a game board can be designed with two zones as mentioned before with two folding and/or detachable half plate portions, in which case the cloth 7 is preferably removable and rolled when the board is folded. When the board is in working position, the cloth would be held on the plate by hangers.

The purpose of troughs 11 is to stop all bowls which are thrown or aimed with too much strength.

According to a possible rule, the game is good only if the jack is thrown inside the area 15, the bowls themselves having stopped inside or outside said area 15, regardless of its path (direct or indirect with rebound against any of bands 9), but necessarily beyond the line 14.

By contrast, all bowls collected in the trough 11 are lost.

Of course, the rules governing the game can vary to a great extent.

Figure 4:
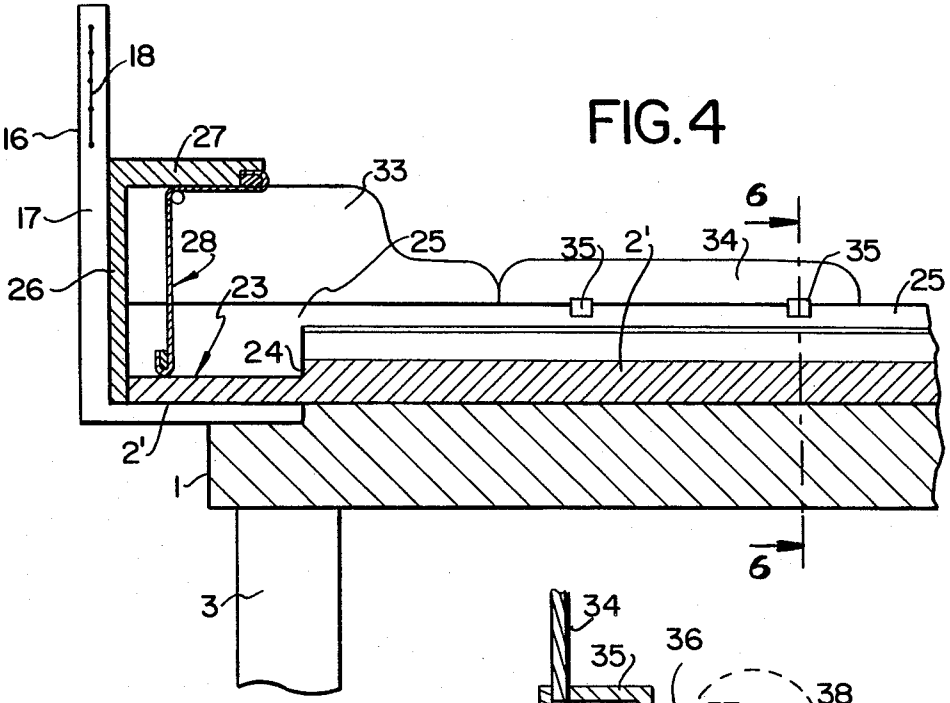
FIG. 4 is a longitudinal vertical section of a game board end complete with ball receiving trough, according to an alternative embodiment.
Figure 6:
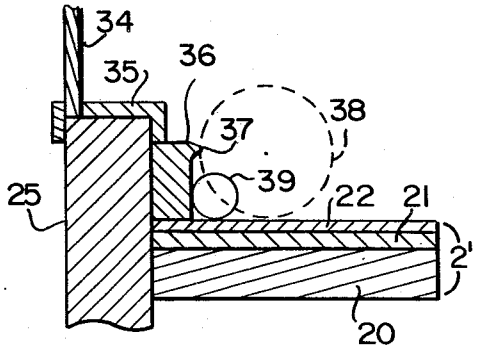
Figure 5:
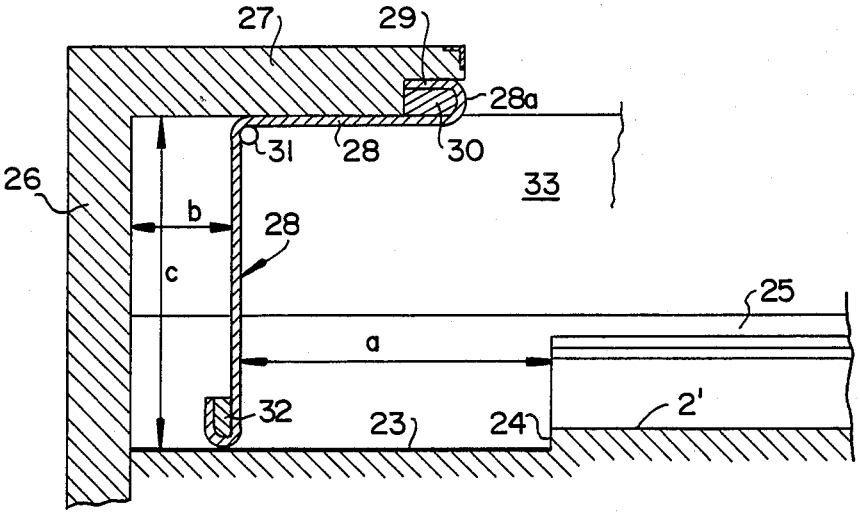
FIG. 5 is an enlarged view of the damping device fitted in said trough and, FIG. 6 is a vertical section along a line VI—VI in FIG. 4 of a longitudinal edges of the game board, at right angles with the damping bank.

FIG. 4 to 6 show a preferred embodiment of the board according to the invention.

The plate 2' formed of a composite structure advantageously comprising (FIG.6) a bottom plate 20, the thickness of which is approximately thirty centimetres, and may be made from broken and agglomerated flax, processed at high temperature with a suitable resin.

Such a material is known and is manufactured particularly by SOBA.

Figure 7:
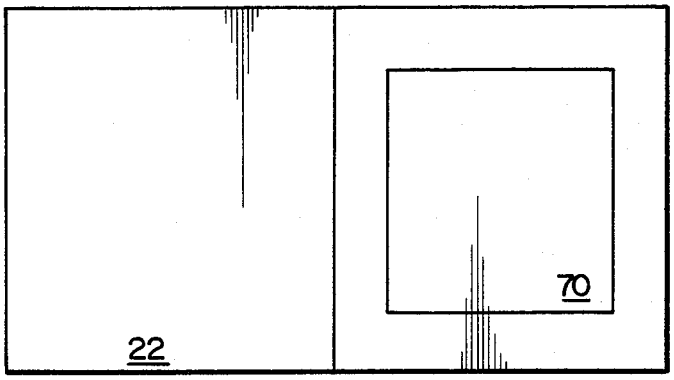
FIG. 7 shows an upper view of the cloth according to FIG. 4.

The upper surface of plate 20 is coated with a 4 mm or so thick high density cork sheet 21, which in turn may be covered with a needled felt-containing carpet or cloth 22, with a thickness of approximately 5 mm. FIG. 7 shows a quadrangular area 70 marked in one-half of the cloth 22.

The game board shown in FIG. 4 to 7 includes only one game zone, of rectangular shape and comprising at the end of the board a trough 23 extending along the lateral side of the board.

The bottom of the trough 23 is within the plane of the game surface, a step 24 marking the limit of said surface. The structure of the trough bottom 23 may be or may be not similar to that of the plate 2' at right angles with the surface of game, but, in all cases, the bottom is clad with a shock and noise-absorbing material.

At either ends, the trough 23 is closed by the two banks 25 extending on the full length of the longitudinal sides of the board.

At the end of the board, the trough 23 is bound by a vertical plate 26 attached to plate 2' and is provided with a horizontal turned portion 27 to which the kinetic energy absorbing means is fastened and that serves for the bowls which come into the collecting trough 23.

This means is composed of a suspended curtain 28 formed by a felt-containing needled carpet, with a thickness of approximately 5 mm. The carpet 28 is rectangular shaped, it extends throughout the length of the trough 23 and is fastened along its upper edge, on the end edge of the turned portion 27. To this purpose, said edge 29 of the carpet 28 is firmly held in the edge of the truned portion 27 by means of a strip 30 fastened to it and the carpet is turned against the inner side of said turned portion 27 so that it hangs, by means of a fixing rod 31 integral with the plate 27, within a distance "a" from the step 24 of approximately 25 cm and a distance "b" from the plate 26 of approximately 7 cm.

The height of the curtain 28 corresponds closely to the distance "c" between the trough bottom 23 and the turned portion plate 27 and is approximately 25 cm, as the lower edge of the curtain 28 is in close vicinity to said trough bottom.

The lower edge of the curtain 28 is, in addition, preferably ballasted with a strip 32 of wood or other material, with a suitable weight of approximately a few hundreds grams and the lower edge of said curtain is rolled over said strip.

The multi-layer structure 20, 21, 22 described in the preceding section has proved to be highly efficient regarding its rolling, shock and noise absorption, kinetic energy absorption properties (anti-rebounding properties) as well as regarding its punching resistance.

On its side, the curtain 28 has proved to be the ideal absorption means for shocks, noise and kinetic energy of all bowls ending into the trough 23, regardless of their speed or direction. This outstanding result is obtained by the type of curtain 28 (a ballasted carpet), by its mode of fastening (hanging freely) and its particular arrangement within the trough. (distances "a", "b" and "c").

It should be observed that the horizontal portion of the carpet 28 closely held against the turned portion 27 has for its purpose to dampen the eventual rebounds of a bowl, that might be caused by a shock against another bowl in the immediate vicinity of the step 24. This also applies for the portion **28*a* of the carpet that covers the lower (rounded) edge of strip 30**.

An advantageous construction of the board is to provide protective flanges 33 above the bank 25 at right angle with the trough 23, also, structures similar to side panels, 34 removably mounted over the bank by means of fork-shaped lugs 35. The items 33 and 34 make it quite impossible that a bowl flies outside the game board (at all events, the risk is a very limited one).

On the other hand, the flanges 33 of fixed construction, co-operate with the plates 26 and 27 to form a bed-head structure, so that, when the board is not in use, it may be advantageously used as a bed, by adding the necessary accessories and more particularly a pillow that can be placed in the trough 23.

Finally FIG. 6 shows another improvement related to the damping means that banks 25 are provided with internally, as the means consists of a flexible band 36 or rubber with appropriate characteristics, with a general rectangular section, and provided, internally and at the top with a small protuding rib 37 and lying against the upper face of the plate 2'.

This arrangement ensures an excellent return of the bowl 38 with very little braking effect (since the rib 37 lies close to the plane of centres of the bowls running on the plate 2') and prevents the event that the jack 39 assumes a position outside the reach of the bowls which would happen if the band 36 did not extend up to the plate 2'.

Of course the invention is not limited to the forms of embodiment that are illustrated and described here but on the contrary, it includes all possible alternatives.

By example, the above-mentioned distances "a", "b", and "c", may vary to some extent from 20 to 30 cm for "a" and "c" and approximately 5–10 cm for "b", depending in particular from the weights and sizes of bowls 38 and of the dimensions of the game board.

The game board structure, shapes and dimensions, the structure, shape and dimensions of the game cloth and of the shock and noise damping means (28, 36) can vary without departing from the spirit of the invention.

I claim:

1. A special game board for the practice of game of bowls, associating some aspects of the games of billiards and of petanque comprising: a rectangular horizontal plate mounted on legs;

laterals bands or banks connected to lateral sides and protruding above the plate;

a resilient padding material attached to at least one lateral band;

a trough for recovering bowls arranged at an end of said plate; a quadrangular area of game marked in a portion of said board provided with said trough;

a resilient material substantially covering said plate to absorb shocks and noise while allowing bowls to run; and means for absorbing shock and noise arranged in said trough;

wherein said plate is a composite structure comprising a lower plate of approximately thirty millimeters thickness, made from agglomerated flax processed at high temperature with a resin, and said resilient material is a high density cork plate, approximately four millimeters thick which is in turn covered with felt approximately five millimeters thick.

2. A game board according to claim 1, wherein said resilient material is a plate of cork or similar material covered with felt or similar cloth material.

3. A game board according to claim 1, wherein said resilient padding material is a resilient return band of rectangular section, connected to said lateral banks extending up to a plane of a game surface and exhibiting an inwardly protruding rib.

4. A game board according to claim 1 wherein said legs are of a length that a playing surface is arranged at 40–50 cm in height.

5. A game board according to claim 1 further comprising at least one game starting bar parallel to a lateral side of the game board and is retractably mounted at a predetermined distance from said sides and slightly below the plane of the game cloth at a game board end.

6. A game board according to claim 5 wherein said bar is fitted with a protective net and pivoted to an upper extension of a transom that delimits the trough.

7. A game board according to claim 6, further comprising protective flanges connected at ends of said trough.

8. A game board according to claim 7, wherein said flanges are continued by removable side panels resting on said longitudinal banks.

9. A game board according to claim 1 wherein said means for absorbing shock and noise is a suspended curtain which is a rectangular shaped carpet exhibiting a ballasted lower edge and lies in the immediate vicinity of the bottom of the trough.

10. A table according to claim 9, wherein said curtain is extended at its upper end and in the direction of the surface of game, by a substantially horizontal portion the end of which matches with a rounded edge of a horizontal plate in overhanging arrangement over a portion of the trough.

11. A game board according to claim 9, wherein said curtain is made of a felt or similar material containing needled curtain, approximately five millimeter thick.

12. A game board according to claim 9 wherein said curtain exhibits a height of 20–30 cm and is 20–30 cm from an edge of said plate and 5–10 cm from a rear wall of said trough.

13. A game board according to claim 9, further comprising at least one game starting bar parallel to a lateral side of the game board and retractably mounted at a predetermined distance from said sides and slightly below the plane of the game cloth.

14. A game board according to claim 13, wherein said bar is fitted with a protective net and pivoted to an upper extension of a transom that delimits the trough.

15. A game board according to claim 9, further comprising protective flanges connected at ends of said trough.

16. A game board according to claim 15, wherein said flanges are continued by removable side panels resting on said longitudinal banks.

17. A special game board for the practice of game of bowls, associating some aspects of the games of billiards and of petanque comprising: a rectangular horizontal plate mounted on legs;

laterals bands or banks connected to lateral sides and protruding above the plate;

a resilient padding material attached to at least one lateral band;

a trough for recovering bowls arranged at an end of said plate; a quadrangular area of game marked in a portion of said board provided with said trough;

a resilient material substantially covering said plate to absorb shocks and noise while allowing bowls to run; and means for absorbing shock and noise arranged in said trough;

wherein said means for absorbing shock and noise is a suspended curtain which is a rectangular shaped carpet exhibiting a ballasted lower edge and lies in the immediate vicinity of the bottom of the trough;

wherein said curtain is extended at its upper end and in the direction of the surface of game, by a substantially horizontal portion the end of which matches with a rounded endge of a horizontal plate in overhanging arrangement over a portion of the trough.

* * * * *